US008984784B2

(12) United States Patent
Vallar

(10) Patent No.: US 8,984,784 B2
(45) Date of Patent: Mar. 24, 2015

(54) IMAGE DISPLAY APPARATUS

(75) Inventor: Brendan Morris Vallar, Glasgow (GB)

(73) Assignee: The Shadow Gap Company LLP (GB)

( * ) Notice: Subject to any disclaimer, the term of this patent is extended or adjusted under 35 U.S.C. 154(b) by 0 days.

(21) Appl. No.: 13/814,052

(22) PCT Filed: Aug. 2, 2011

(86) PCT No.: PCT/GB2011/051466

§ 371 (c)(1),
(2), (4) Date: Feb. 4, 2013

(87) PCT Pub. No.: WO2012/017240

PCT Pub. Date: Feb. 9, 2012

(65) Prior Publication Data

US 2013/0125436 A1 May 23, 2013

(30) Foreign Application Priority Data

Aug. 5, 2010 (GB) ..... 1013176.1

(51) Int. Cl.
*A47G 1/06* (2006.01)

(52) U.S. Cl.
CPC ..... *A47G 1/0622* (2013.01); *A47G 1/06* (2013.01)
USPC ..... 40/714; 40/800; 40/735; 40/798; 40/799; 40/732; 206/216

(58) Field of Classification Search
USPC ..... 40/714, 800, 735, 798, 799, 732; 206/216
See application file for complete search history.

(56) References Cited

U.S. PATENT DOCUMENTS

| | | | | | |
|---|---|---|---|---|---|
| 1,805,436 | A | * | 5/1931 | Barnard | 40/798 |
| 2,208,001 | A | | 7/1940 | Grant | |
| 2,677,909 | A | * | 5/1954 | Heydenryk | 40/714 |
| 3,517,452 | A | | 6/1970 | Finley | |
| 3,786,584 | A | * | 1/1974 | Holson | 40/124 |
| 3,897,645 | A | | 8/1975 | Scheyer | |
| 3,946,863 | A | * | 3/1976 | Glasband et al. | 206/216 |
| 4,170,836 | A | * | 10/1979 | Seufert | 40/773 |
| 4,229,892 | A | | 10/1980 | Hueter et al. | |
| 4,967,499 | A | * | 11/1990 | Rosenberg | 40/732 |
| 5,269,083 | A | | 12/1993 | Vampatella et al. | |
| 5,904,962 | A | * | 5/1999 | Harding et al. | 428/14 |

(Continued)

FOREIGN PATENT DOCUMENTS

| | | |
|---|---|---|
| BE | 1012854 | 4/2001 |
| CN | 201727205 | 7/2010 |

(Continued)

*Primary Examiner* — Syed A Islam
(74) *Attorney, Agent, or Firm* — Law Office of Jesse D. Lamber, LLC

(57) ABSTRACT

An image display apparatus (10) for displaying one or more images (20) such as photographs. The image (20) is mounted on a raised portion (14) around which is arranged a further raised portion (16) as a mounting panel (8). The portions are separated to provide a gap (30) there between which gives the illusion that the image and the mounting panel (18) are floating. This effect accentuates the image which is additionally enhanced by the choice of color of the mounting panel (18). The portions are located on a backing panel which extends beyond the perimeter of the mounting panel to provide an additional framing feature. The backing panel (12) and mounting panel (18) are made of durably rigid materials such as Perspex® or aluminum so that the apparatus can be mounted without a frame.

13 Claims, 5 Drawing Sheets

(56) References Cited

U.S. PATENT DOCUMENTS

| | | | | |
|---|---|---|---|---|
| 6,209,248 | B1 | 4/2001 | Reinhard | |
| 6,472,038 | B1 * | 10/2002 | Murphy | 428/40.1 |
| 6,536,148 | B2 | 3/2003 | Heiliger | |
| 2004/0040195 | A1 | 3/2004 | Copley | |
| 2007/0151136 | A1 | 7/2007 | Dandie | |
| 2008/0120882 | A1 * | 5/2008 | Mueller | 40/714 |
| 2009/0019753 | A1 | 1/2009 | Hayashi | |

FOREIGN PATENT DOCUMENTS

| | | |
|---|---|---|
| DE | 004113712 | 4/1991 |
| DE | 29811685 | 2/1999 |
| ES | 2020472 | 4/1990 |
| FR | 2621234 | 10/1987 |
| GB | 552239 | 4/1942 |
| GB | 2163048 | 2/1986 |
| GB | 2214805 | 9/1989 |
| GB | 2396808 | 7/2004 |
| GB | 2424832 | 10/2006 |
| GB | 2461169 | 12/2009 |
| KR | 20100002333 | 3/2010 |
| NL | 007907921 | 6/1981 |
| WO | WO2007045018 | 4/2007 |

* cited by examiner

IMAGE DISPLAY APPARATUS

The present invention relates to image display apparatus and more specifically to improved apparatus for mounting an image for display purposes and also for preventing the copying of a displayed image.

It is commonplace to mark important events in the lives of friends and relatives by having a professional photographer record these events on film or digitally. This film is subsequently developed in a laboratory, or by the photographer, and appropriate prints are chosen for mounting in a framing arrangement in order that they may be put on display. Such a framing arrangement can be seen in FIGS. 1(*a*) and (*b*) where the constituent parts of the framing arrangement are shown. Such framing arrangements have become the standard method of securing a photograph for displaying.

Traditionally, there are two methods of framing images. Firstly, a frame goes over the outer edge of the image and the image is framed by the inner edge of the frame. Secondly, the frame is provided with additional elements such as a mounting sheet and glass.

FIGS. 1(*a*) and 1(*b*) show an example of a prior art image framing arrangement A. FIG. 1(*a*) is a cross sectional side view of the arrangement and shows a frame B with a flange C. An image D and mounting sheet E are held between a glass piece F and backing panel G, the backing G being held in place with clips H at the bottom and by the flange C of the frame B at the top; in addition, all items except the image abut against the side of the frame B below and perpendicular to the flange C. The image is secured to the mounting sheet E with adhesive and the inner perimeter of the mounting sheet E defines an image area I where the image is viewable. Frames of this type require the image to be rear mounted which involves much skill in properly aligning the image and ensuring that the final product is dust free. Additionally, they can be easily disassembled and the image may be removed and illegally copied.

UK Patent GB 2424832B describes an image display apparatus which includes a frame and a support member having a raised portion upon which an image, such as a photograph, can be mounted. Securing means are provided for securing the frame to the support member such that the frame surrounds the raised portion. The area of the raised portion may be smaller than the inner area of the frame to provide a gap between the frame and the raised portion, to give the impression of the image floating in the frame. The image may be secured to the raised portion by an adhesive layer to prevent removal for copying. A method for front mounting an image in a frame is also disclosed.

This prior art image display apparatus had advantages over the traditional frame of FIG. 1 by providing a front loading picture frame in which it was easier to centre the image; created a shadow gap between the frame and image to make the image appear to be floating, and aided in preventing copying as the image was secured in the frame.

However, the image display apparatus has a major disadvantage. As shown in FIG. 1, traditional framing includes a mounting sheet which overlies the edges of the picture being framed to provide a decorative edging within the framing apparatus. This mounting sheet is typically card of a single colour, with the colour being selected to accentuate a colour within the image itself. Such an enhancement to the image is not available in the prior art apparatus of GB 2424832B.

It is therefore an object of the present invention to provide an image display apparatus which provides the benefits of the image display apparatus of GB 2424832B with the image enhancement of a traditional mounting sheet.

According to a first aspect of the present invention there is provided an image display apparatus, the apparatus comprising a backing panel; one or more first raised portions located upon the panel, each first raised portion having an upper surface upon which is secured an image for display, the image extending to at least an edge of the first raised portion; one or more second raised portions located upon the panel, each second raised portion having an upper surface upon which is secured a mounting panel, each mounting panel having at least one inner edge arranged to surround a perimeter of each first raised portion such that each image is located within and spaced apart from a mounting panel to create a channel therebetween; and the backing panel extends beyond an outer edge of the mounting panel.

In this way, the mounting panel will accentuate the image, while the image and the mounting panel both appear to be floating as a result of the shadow gap created by the channel between them and the apparent depth created between the outer edge of the mounting panel and the backing panel. The image display apparatus also has the advantages of being front loaded, without glass, so that the image(s) and mounting panel(s) can be positioned easily and, as the images are secured to the raised portions, aids in preventing illegal copying. Yet further, the channel removes the requirement for the inner edge of the mounting panel to be cut to a close tolerance to meet the outer edge of the image, which is generally highly impractical to achieve.

Preferably, each mounting panel is formed of a rigid durable material. In this way, the apparatus is robust. If traditional card were used, this would degrade quickly as there is no glass cover present to provide protection.

Preferably, each mounting panel is formed from a sheet of plastic such as Perspex®. Plastics and solid resins are easy to cut and handle while being rigid. Their edges can also be polished to provide an aesthetic, clean appearance.

Optionally, each mounting panel may be formed from a sheet of metal such as aluminium. Sheet metal is easy to cut and handle while being rigid. Their edges can also be polished to provide an aesthetic, clean appearance.

Advantageously, each mounting panel is formed of at least a partially reflective material. The present applicants have discovered that a reflective surface further enhances the image without the distracting effect of the prior art in having reflective glass over the image.

Preferably each image is arranged to overhang the edge of the first raised portion. This increases the apparent floating effect. Preferably each mounting panel is arranged to overhang the second raised portion. This further increases the apparent floating effect.

Preferably, the backing panel is formed of a rigid durable material. In this way, the apparatus is robust and can be used without a frame. A purchaser can choose to mount the apparatus in a frame of their choosing. Optionally, the apparatus includes a frame, the frame being secured to the backing panel and sized to provide a channel between the outer edge of the mounting panel and an inner edge of the frame. The channel provides a shadow gap to maintain the floating effect. Yet further, the channel removes the exacting and in common practice, highly impractical requirement, for the inner edge of the mounting panel to be cut to a close level of tolerance to meet the outer edge of the frame. Thus reducing costs and simplifying assembly.

Preferably, the backing panel is formed from a sheet of plastic such as Perspex®. Plastics and solid resins are easy to cut and handle while being rigid. Their edges can also be polished to provide an aesthetic, clean appearance.

Optionally, the backing panel may be formed from a sheet of metal such as aluminium. Sheet metal is easy to cut and handle while being rigid. Their edges can also be polished to provide an aesthetic, clean appearance.

Advantageously, the backing panel is formed of at least a partially reflective material. The present applicants have discovered that a reflective backing panel further accentuates the floating effect of the image and mounting panel by increasing the apparent depth of the channel.

Preferably, the apparatus includes one or more light emitting devices located within the channel. The devices may be light bulbs, fluorescent bands or LEDs. In this way, a background light is created in the channel which highlights the shadow gap.

Embodiments of the present invention will now be described, by way of example only, with reference to the accompanying drawings of which:

Figure 2A:
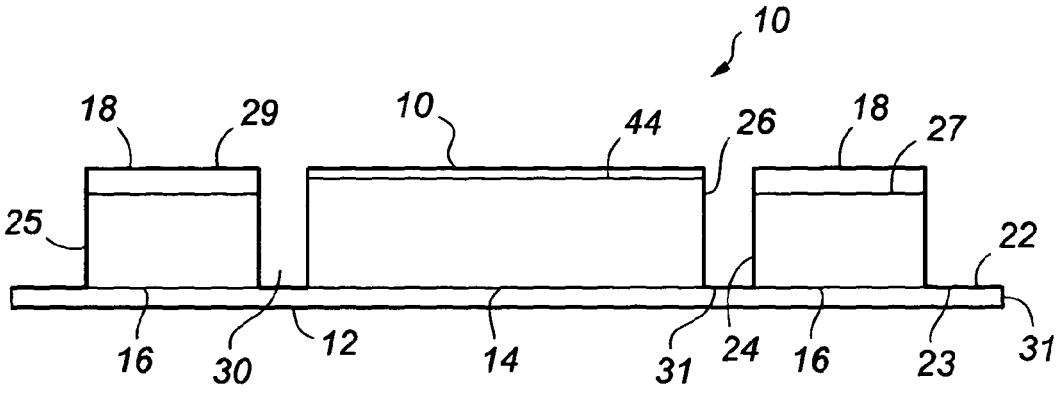
FIG. 2 is an illustration of an image display apparatus according to a first embodiment of the present invention with FIG. 2(*a*) being a cross sectional view and FIG. 2(*b*) being a perspective view.
Figure 2B:
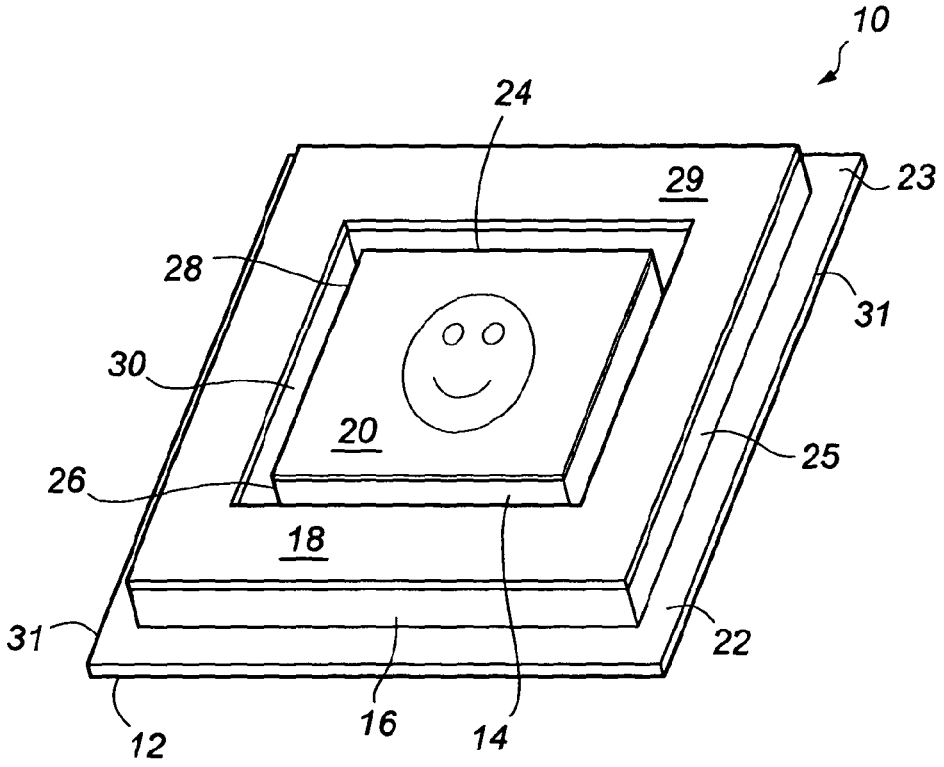

Reference is initially made to FIGS. 2(*a*) and (*b*) of the drawings which illustrates an image display apparatus, generally indicated by reference numeral 10, having a backing panel 12, a first raised portion 14, a second raised portion 16, a mounting panel 18 and an image 20 for display, according to a first embodiment of the present invention.

Image 20 is a photograph or other work of art which requires to be displayed. The image 20 is located upon a platform 14. In this embodiment the platform 14 has a length and breadth which matches that of the image 20. It is then simple to locate the image 20 upon the upper surface 24 of the platform 14. Typically there will be an adhesive layer on the surface 24 which is exposed before the image 20 is affixed thereon. Once affixed the image 20 cannot be removed for copying purposes.

Beneficially the image 20 is effectively 'front loaded' as the apparatus 10 faces the user to mount the image 20.

The platform 14 is a raised section, in this embodiment it is substantially square, but it may be of any two dimensional shape, such as rectangular, circular or oval. The platform 14 is affixed to a backing substrate 22 which is a large flat panel, typically of similar shape to the platform 14. The platform 14 is a box affixed to the substrate 22, or may be integral with the substrate 22, to provide an upper surface 44 which sit's proud and away from the surface 23 of the substrate 22.

The substrate 22 is made of a rigid durable material. This is distinct from the card and cardboard traditionally used, as these materials would degrade quickly as they are exposed in use and do not have the traditionally glass cover to protect them. The substrate 22 is cut from a sheet of Perspex®. Perspex® is a rigid plastics material which in 2-3 mm thicknesses provides a substantial ruggedness while still being able to be cut using simple cutting tools such as saws. Once cut the Perspex® edges can be smoothed and polished. Alternatively the substrate 22 may be formed from a metal sheet, such as aluminium. This also provides a highly rugged and durable backing to support the other components of the apparatus 10. The use of Perspex® allows the surface 23 of the substrate 22 to have a colour selected by the user. The surface 23 may also be polished to provide a partially reflective surface 23. Use of a polished metal gives a mirrored surface 23 which is highly reflective.

Located around the first platform 14, is a second platform 16. Platform 16 is substantially ring-shaped or annular to surround the first platform 14. It has an inner edge 24 and an outer edge 25. The second platform 16 is also of a box like construction to provide an upper surface 27 raised above the upper surface 23 of the substrate 22. The second platform 16 is affixed to the substrate 22 or may be made integral with the substrate 22. A mounting panel 18 is located upon the upper surface 27 of the second platform 16. The mounting panel 18 is preferably cut to match the surface 27.

The mounting panel 18 is made of a rigid durable material. This is distinct from the paper and card traditionally used, as these materials would degrade quickly as they are exposed in use and do not have the traditionally glass cover to protect them. The mounting panel 16 is cut from a sheet of Perspex®. Perspex® is a rigid plastics material which in 2-3 mm thicknesses provides a substantial ruggedness while still being able to be cut using simple cutting tools such as saws. Once cut the Perspex® edges can be smoothed and polished. Alternatively the mounting panel 18 may be formed from a metal sheet, such as aluminium. This also provides a highly rugged and durable surface 29. The use of Perspex® allows the surface 29 of the mounting panel 18 to have a colour selected by the user. The surface 29 may also be polished to provide a partially reflective surface 29. Use of a polished metal gives a mirrored surface 29 which is highly reflective.

The inner edge 24 of the mounting panel 18 and the platform 16 follows the perimeter of the image 20 and the first platform 14 to entirely enclose the first platform 14. The shape of the inner edge 24 substantially matches the shape of an outer edge 26 of the image 20 and the first platform 14. However the edges 24, 26 do not meet and a space or gap 30 is left there between. Ideally the gap 30 is of uniform width. A base 31 of the gap 30 exposes the surface 23 of the substrate 22.

In a preferred embodiment the upper surface of the image 20 and the surface 29 of the mounting panel 18 are arranged to project from the surface 23 of the substrate 22 by the same distance. This provides a uniform projected surface to the apparatus 10. The gap 30 gives the effect that the image 20 is floating. Additionally the mounting panel 18 will appear to float but also appear distinct from the image 20 so as to aesthetically enhance and frame the image 20. By choosing a colour for the panel 18 based on the colours in the image 20, the image 20 is further enhanced in the same fashion as would be provided by a mounting panel in a traditional picture frame.

The floating appearance of the panel 18 is further enhanced by the spacing between the outer edge 25 of the panel 18 and the outer edge 31 of the substrate 22. By exposing a perimeter of the substrate surface 23 around the panel 18, this acts to frame the panel 18 and due to the difference in heights, as the panel rests on the platform 16, the depth creates an impression that the panel 18 is floating. The floating effect can be enhanced if the substrate surface 23 is reflective or mirrored.

The substrate 22 acts as a backing panel to support the component parts of the apparatus 10. As the substrate 22 is rigid and durable, the apparatus 10 can be directly mounted on a wall.

Figure 3A:
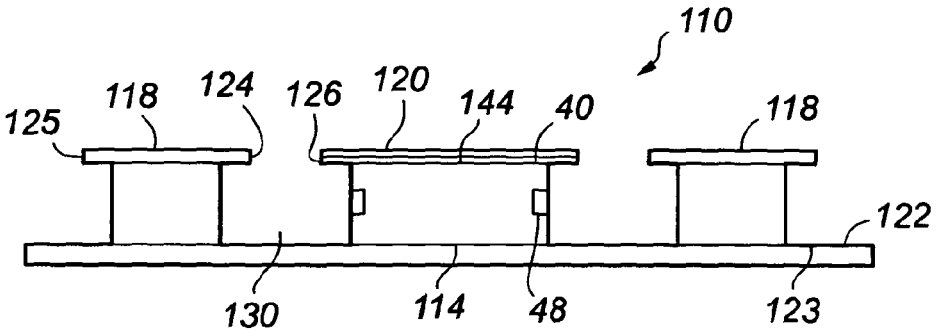
FIG. 3 is an illustration of an image display apparatus according to a second embodiment of the present invention with FIG. 3(*a*) being a cross sectional view and FIG. 3(*b*) being a perspective view.
Figure 3B:
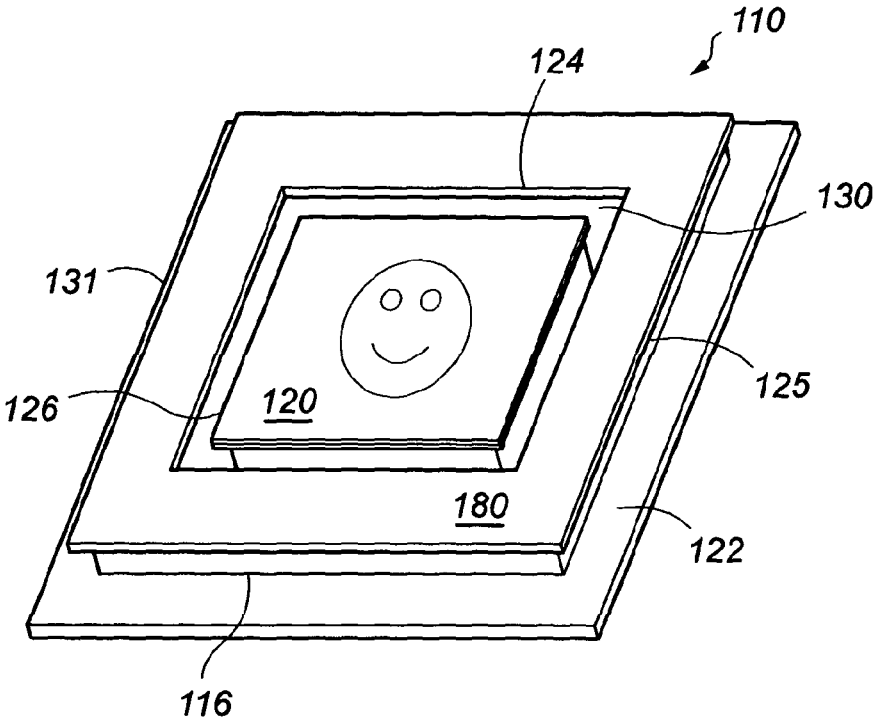

Reference is now made to FIGS. 3(*a*) and 3(*b*) of the drawings which illustrate an image display apparatus, generally indicated by reference numeral 110, having a backing panel 112, a first raised portion 114, a second raised portion 116, a mounting panel 118 and an image 120 for display, according to a second embodiment of the present invention. Like parts to those of the apparatus 10 in FIG. 2 have been given the same reference numeral with the addition of 100 to aid clarity.

Apparatus 110 closely resembles apparatus 10 except in that the raised portions or platforms 114, 116 do not extend to meet the edges of the image 120 and the mounting panel 118 respectively. Thus the outer edge 124 of the image 120 now overhangs the surface 144 of the platform 114. Similarly both the inner edge 126 and the outer edge 125 of the panel 118 overhang the upper surface 127 of the second platform 116. This arrangement increases the width of the gap 130 and provides an increased sense that the image 120 and the mounting panel 118 are floating. By making the panel 118 of a rigid durable material the overhanging portions are less likely to be damaged. To provide a similar rigidity to the image 120, a supporting panel 40 can be located between the image 120 and the platform 114, the panel 40 being sized to match the area of the image 120 so that it is fully supported across its surface. The panel 40 preferably has a thickness not greater than the mounting panel 18, so as not to spoil the floating effect. As an example, the mounting panel 18 may have a thickness of 1 to 3 mm and the platforms 114,116 may have a thickness of 10 to 15 mm.

Apparatus 110 also includes lights 48. Lights 48 are provided as a row of LEDs, located in the raised portion 114 and directed into the gap 130. These enhance the effect of the image 120 and mounting panel 118 floating by increasing the apparent distance between the image 120 and the backing panel 122. While the lights 48 are shown as LEDs, they may be any light emitting devices. Additionally, while the lights 48 are shown located on the side panel of the raised portion 114, they could be mounted on the opposite side panel of the raised platform 116, mounted on or in the substrate 122 or even mounted under the overhang of the image 120 or mounting panel 118. Similarly lights may be located on the opposite side of the raised portion 116, to enhance the floating effect at the perimeter 125 of the mounting panel 118.

Figure 1A:
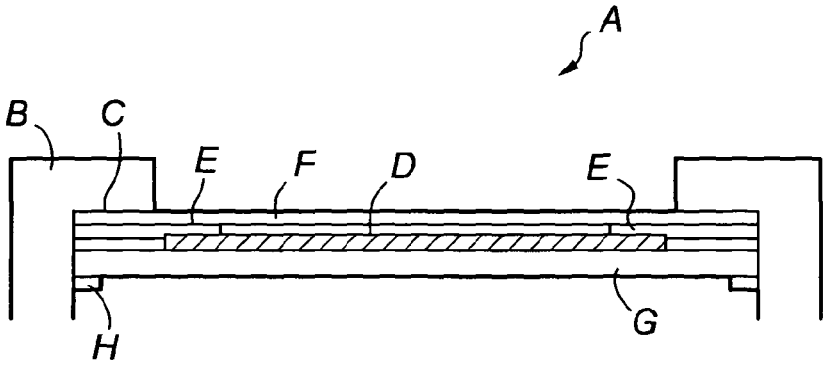
FIG. 1 is an illustration of a prior art image display apparatus with FIG. 1(*a*) being a cross sectional view and FIG. 1(*b*) being a perspective view.
Figure 1B:
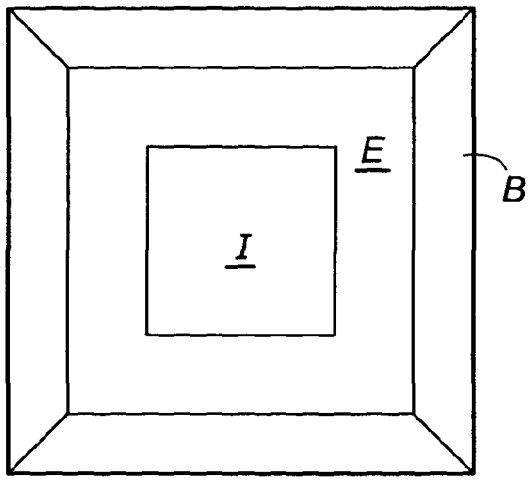
Figure 4A:
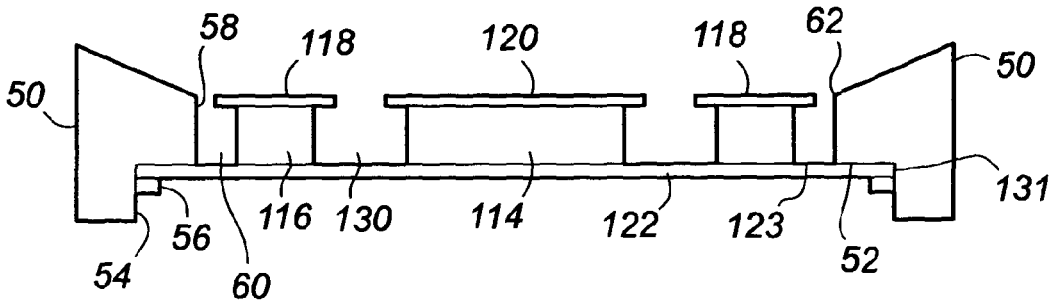
FIG. 4 is an illustration of an image display apparatus according to a third embodiment of the present invention with FIG. 4(*a*) being a cross sectional view and FIG. 4(*b*) being a perspective view.
Figure 4B:
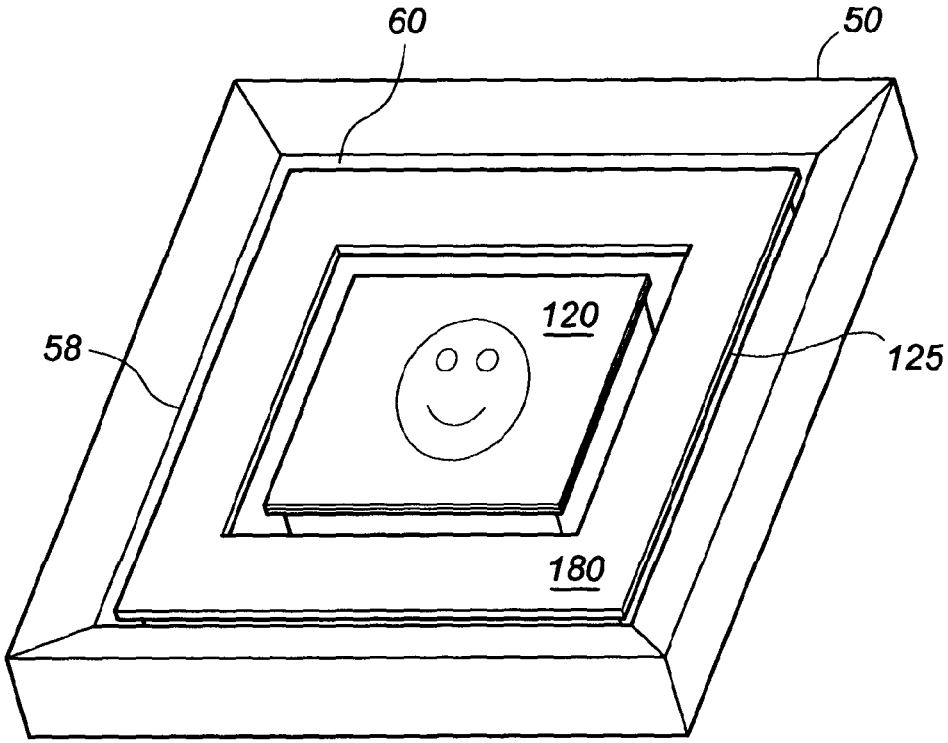

Reference is now made to FIGS. 4(*a*) and 4(*b*) of the drawings which illustrate the image display apparatus 110 of FIGS. 3(*a*) and (*b*) with the inclusion of a frame 50. Like parts to those of the apparatus 110 in FIG. 3 have been given the same reference numeral to aid clarity. Frame 50 is as known in the art and as substantially illustrated in FIG. 1. In cross-section, the top bottom and sides of the frame 50 are provided by a moulding having a substantially rectangular form. In the embodiment described, the height of the moulding decreases from the outer edge of the moulding to the inner edge although this may be altered to alter the appearance of the frame 50.

The frame 50 is sized and arranged such that the upper surface 123 of the backing substrate 122 abuts a lower surface 52 of the frame 50. Additionally, an outer edge 131 of the substrate 122 also reaches an inner edge 154 of the frame 50. These edges need not match exactly as a clip 56 is attached, in a known manner, at intervals around the frame 50 to hold the substrate 122 to the frame 50.

In selecting the frame 50, the perimeter described by an innermost edge 58 is selected to be greater than a perimeter of the outer edge 125 of the mounting panel 118. This difference creates a gap 60 between the mounting panel 118 and the frame 50 which exposes the surface 123 of the substrate 122. Gaps 130, 60 may be referred to as a double shadow gap, which together help accentuate the apparent floating nature of the mounting panel 118 and the image 120. The presence of the gap 60 also allows for variable sizes of frame 50 to be used as a tight tolerance is not required between the frame 50 and the mounting panel 118. In an embodiment the heights of the panel 118 and the image 120 match the 'sight edge' 62 of the frame. This arrangement 110, provides a framed image in which the image and mounting panel give the illusion of floating within the frame.

As there is no glass in the apparatus 110, the substrate 122 can be fixed in the frame 50 before the image 120 and/or mounting panel 118 are located by front loading the frame 50. Alternatively the apparatus 110 can be entirely assembled and then the frame 50 is dropped over the substrate 122 and affixed in place. This ability to 'front load' the frame 50 assists in positioning the mounting panel 118 equidistantly from the edge 58 of the frame 50 on the respective sides.

Figure 5A:
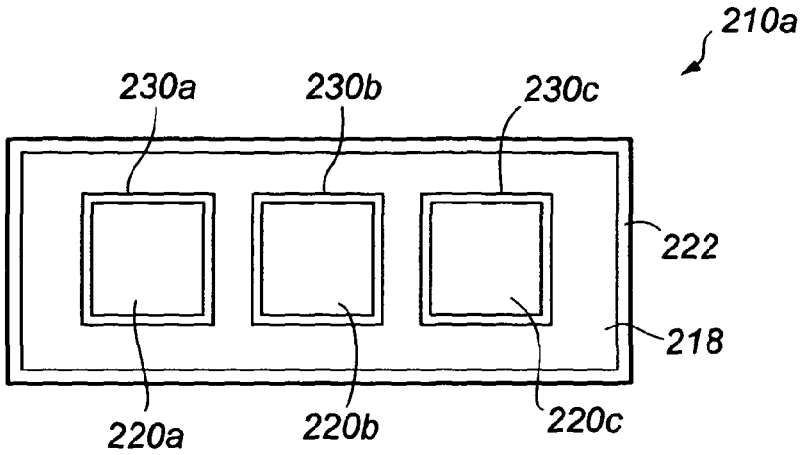
FIGS. 5(*a*)-(*c*) are illustrations of further embodiments of the present invention, viewed from the front.
Figure 5B:
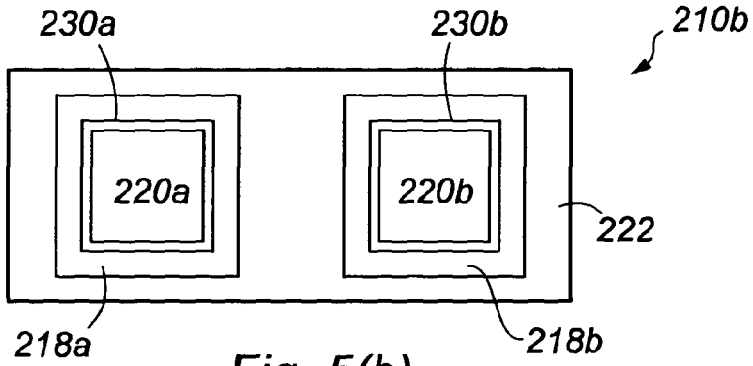
Figure 5C:
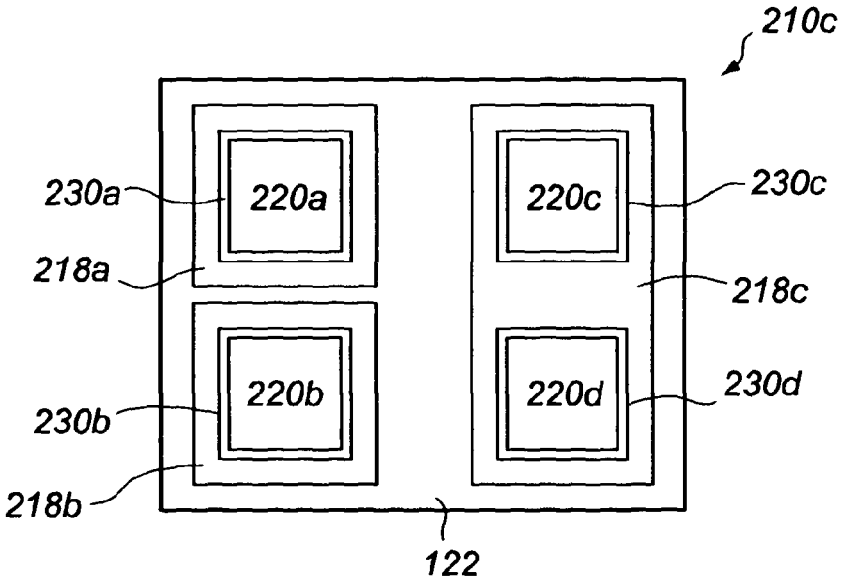

Various numbers of images 20,120 and mounting panels 18, 118 can be used upon a backing panel 22, 122. Illustrations of example embodiments are shown in FIGS. 5(*a*)-(*c*). Like parts to those of FIG. 2 have been given the same reference numeral with the addition of 200, to aid clarity.

In each embodiment, 210*a,b,c* each image 220 is enclosed by a mounting panel 218 to provide a gap 230 there between. In this way, all the images 220 have the illusion of floating. Additionally, each mounting panel 218, is surrounded by an exposed section of the substrate 222, to provide depth around the panels 218 and also give the appearance that the panels 218 are floating also.

In FIG. 5(*a*) three images 220*a-c* are displayed in a linear arrangement with a common mounting panel 218. In FIG. 5(*b*) two images 220*a,b* are displayed, each having a mounting panel 218*a,b* arranged to frame and accentuate each image. In this arrangement a larger portion of the surface of the back panel 222 is viewed. In FIG. 5(*c*) four images 220*a-d* are displayed. In this arrangement, two of the images 220*a,b* have their own mounting panels 218*a,b* while the two other images 220*c,d* share a mounting panel 218*c*. The Figures illustrate that there may be a smaller number of mounting panels 218 than images 220, as each panel can have a number of apertures located therein for the positioning of the first platform 214 and the image 220.

Contemporary portrait photography places the subjects(s) on a white background. If these images are mounted on the apparatus of the present invention, they can be enhanced by choosing a white or black Perspex® mounting panel with a contrasting surface to the backing substrate. A polished metal surface to the backing panel works exceptionally well at providing a shadow gap between the images and the panel.

The principal advantages of the present invention are that it provides an image display apparatus which can be front loaded, prevents the image being removed and copied, and provides the illusion of the image appearing to float while being enhanced by a coloured mounting panel, which itself appears to float.

A further advantage of at least one embodiment of the present invention is that it provides an image display apparatus which does not require a frame for presentation, but a frame may be used if so desired.

A yet further advantage of the present invention is that it provides an image display apparatus which uses new materials in the form of plastics and metals which provide a rugged apparatus that does not require a glass cover to protect the contents.

It will be appreciated by those skilled in the art that various modifications may be made to the invention herein described without departing from the scope thereof. For example, while it is assumed that the mounting panel is of a uniform colour, the panel may be of a selection of colours and/or have a surface which is textured.

Additionally, while the image is shown as a photograph or drawing, any 2-D or 3D image could be used with the apparatus, particularly as a glass cover is not required. Also, the shapes of the edges of the image(s) and the mounting panel(s) need not be square, rectangular, oval or circular, but may equally be of a free form as long as a shadow gap is left between the image and the mounting panel, and an exposed area of the surface of the substrate is left around the mounting panel.

The invention claimed is:

1. An image display apparatus, the apparatus comprising a backing panel; one or more first raised portions located upon the panel, each first raised portion having an upper surface upon which is secured an image for display, the image extending to at least an edge of the first raised portion; one or more second raised portions located upon the panel, each second raised portion having an upper surface upon which is secured a mounting panel, each mounting panel having at least one inner edge arranged to surround a perimeter of each first raised portion such that each image is located within and spaced apart from a mounting panel to create a channel therebetween; and the backing panel extends beyond an outer edge of the mounting panel so that a perimeter of the backing panel is exposed around the mounting panel to frame the mounting panel.

2. An image display apparatus as claimed in claim 1 wherein each mounting panel is formed of a rigid durable material.

3. An image display apparatus as claimed in claim 2 wherein each mounting panel is formed from a sheet of plastic.

4. An image display apparatus as claimed in claim 2 wherein each mounting panel is formed from a sheet of metal.

5. An image display apparatus as claimed in claim 1 wherein each mounting panel is formed of at least a partially reflective material.

6. An image display apparatus as claimed in claim 1 wherein each image is arranged to overhang the edge of the first raised portion.

7. An image display apparatus as claimed in claim 1 wherein each mounting panel is arranged to overhang the second raised portion.

8. An image display apparatus as claimed in claim 1 wherein the backing panel is formed of a rigid durable material.

9. An image display apparatus as claimed in claim 8 wherein the backing panel is formed from a sheet of plastic.

10. An image display apparatus as claimed in claim 8 wherein the backing panel is formed from a sheet of metal.

11. An image display apparatus as claimed in claim 1 wherein the backing panel is formed of at least a partially reflective material.

12. An image display apparatus as claimed in claim 1 wherein the apparatus includes a frame, the frame being secured to the backing panel and sized to provide a channel between the outer edge of the mounting panel and an inner edge of the frame.

13. An image display apparatus as claimed in claim 1 wherein the apparatus includes one or more light emitting devices located within the channel.

* * * * *